US006607293B2

(12) United States Patent
Sanuki et al.

(10) Patent No.: US 6,607,293 B2
(45) Date of Patent: Aug. 19, 2003

(54) REAR COMBINATION LAMP

(75) Inventors: Hidenori Sanuki, Shizuoka (JP); Takanori Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/725,867

(22) Filed: Nov. 30, 2000

(65) Prior Publication Data

US 2001/0002170 A1 May 31, 2001

(30) Foreign Application Priority Data

Nov. 30, 1999 (JP) ..... P. 11-340376

(51) Int. Cl.[7] ..... F21S 8/00

(52) U.S. Cl. ..... 362/430; 362/421; 362/455; 362/519; 362/548; 439/336; 439/57; 439/546; 439/333

(58) Field of Search ..... 362/430, 421, 362/455, 36, 226, 519, 548; 439/336, 546, 57, 332, 333, 547, 548, 549

(56) References Cited

U.S. PATENT DOCUMENTS 4,076,359 A * 2/1978 Brownlee ..... 339/32 R
4,562,518 A * 12/1985 Kumagai ..... 362/249
5,536,175 A * 7/1996 Forish ..... 439/57
6,083,012 A * 7/2000 Suzuki et al. ..... 362/226

FOREIGN PATENT DOCUMENTS

| | | | |
|---|---|---|---|
| DE | 3531 072 C2 | 9/1987 | |
| DE | 198 50 892 A1 | 6/1999 | |
| JP | 3-20979 | 1/1991 | ..... H01R/33/46 |
| JP | 6-11206 | 2/1994 | ..... F21Q/1/00 |
| JP | 6-275117 | 9/1994 | ..... F21V/19/00 |

* cited by examiner

*Primary Examiner*—Sandra O'Shea
*Assistant Examiner*—Bertrand Zeade
(74) *Attorney, Agent, or Firm*—Sughrue Mion, PLLC

(57) ABSTRACT

A rear combination lamp 1 is arranged in a manner that a wiring portion 6 is formed and divided into plural pieces along the periphery of the socket inlet 5 of a lamp body 2, a conductor 7 is divided into plural pieces and the plural pieces of the conductors are wired at the plural pieces of the wiring portion 6, respectively, and stop ribs 10 for restricting the insertion amount of a socket 20 are provided at the vicinity of guide grooves 9 which guide bayonets 25 when the bayonets 25 provided at the socket 20 is fitted to the wiring portion thereby to attach the socket to the lamp body. At the time of attaching the socket 20 to the lamp body 2, when a socket body 21 is inserted into the socket inlet 5, terminal contacts are brought into contact with the conductors 7, whereby the one end of the socket 20 abuts against a top face of the stop ribs 10. Thus, since the insertion amount of the socket 20 is restricted, the excessive deformation of the terminal contacts can be surely prevented.

4 Claims, 7 Drawing Sheets

REAR COMBINATION LAMP

BACKGROUND OF THE INVENTION

The present invention relates to a rear combination lamp used for an automobile etc. and, more particularly, relates to the structure of a lamp body for realizing a good contacting state between a terminal provided at a socket and a conductor wired at the lamp body.

Various kinds of related rear combination lamps used in vehicles such as automobiles etc. have been known. For example, a rear combination lamp 41 shown in FIG. 10 is formed by a lamp body 42 and a socket 60. The rear combination lamp is arranged in a manner that, when the socket 60 is attached to the lamp body 42, a lamp 66 attached to the socket 60 can be coupled to conductors 47 wired at a wiring portion 46 formed at the lamp body 42.

The lamp body 42 is configured by a socket holder 43 formed in a hollow and almost frustum shape and a lens portion 44 formed integrally at the bottom face of the socket holder 43. The lower portion of a socket inlet 45 is formed in a hollow shape and provided at a not-shown inner wall thereof with a reflection mirror for suppressing the loss of light of the lamp within the lamp body 42.

The peripheral wall on the upper face of the socket holder 43 is bent so as to expand toward the center direction of the socket inlet 45 to form the annular wiring portion 46. The conductors 47 are wired on the upper face of the wiring portion 46. The wiring portion 46 is provided at the inner peripheral wall thereof with guide grooves 49 for fitting with bayonets 65 formed on the socket 60.

The four guide grooves 49 are formed at the peripheral edge of the socket inlet 45 with an interval of 90 degrees. The wiring portion 46 is divided into four pieces by the guide grooves 49 and each of the conductors 47 is wired in an arc shape on the associated one of the four pieces of the wiring portion. The conductors 47 are wired so as to be buried within wiring grooves 48 formed on the wiring portion 46 as shown in FIG. 11.

The wiring portion 46 is provided at the outer side portion thereof with eight welding ribs 51 for fixing the conductors 47 and eight rectify ribs 71 serving as bending fulcrums when wiring the conductors 47 near the welding ribs 51. Thus, the both end portions of each of the conductors 47 are bent by the associated rectify ribs 71 and welded in a state being sandwiched by the associated welding ribs 51, respectively.

The diameter of the socket holder 45 and the number of the guide grooves 49 etc. are not limited to predetermined values and changed in accordance with the standard of the lamp 66 attached to the socket inlet 45.

As shown in FIG. 11, the socket 60 is formed by a socket body 61 and a flange 62 of a circular plate shape and arranged in a manner that terminals 67 are housed within the socket body 61. Each of the terminals 67 includes a contact 67*a* whose one end is provided with elasticity. The terminals are inserted in a fitting manner into the socket body 61 in a manner that the contacts 67*a* protrude on the face of the flange 62 from the side face of the socket body 61.

The socket body 61 is provided on the side wall face thereof with the bayonets 65 for positioning and engaging which are fitted into the guide grooves 49 when attaching the socket 60 to the socket inlet 45. The bayonets 65 are provided in correspondence with the number and the positions of the guide grooves 49. In this example, four bayonets 65 are provided.

When attaching the socket 60 to the aforesaid lamp body 42, as shown in FIG. 10, the socket is inserted within the socket inlet 45 in the direction shown by an arrow B such that the socket body 61 is directed downward. In this case, upon inserting the socket, the socket body is positioned so as to align the bayonets 65 to the associated guide grooves 49, respectively. The guide grooves 49 are formed to have different shapes so as to prevent the erroneous insertion of the socket 60, and the bayonets 65 are formed to have the configurations matched to the associated guide grooves 49, respectively.

When the guide grooves 49 are aligned to the associated bayonets 65, respectively, the socket body 61 can be fitted within the socket inlet 45. In this case, the socket body 61 is inserted into the socket inlet 45 and then rotated in the direction shown by an arrow C thereby to attach the socket 60 to the lamp body 42. Thus, as shown in FIG. 11, the contacts 67*a* contact to the conductors 47, whereby the lamp 66 attached to the socket body 61 can be electrically connected.

The conductors 47 are buried within the wiring grooves 48 formed on the wiring portion 46. Thus, when the socket body 61 is inserted within the socket inlet 45 and rotated in the direction shown by the arrow C, although the contacts 67*a* slide on the conductors 47, the conductors 47 are prevented from moving out of the wiring grooves 48, whereby the contacts 67*a* can be surely made in contact with the conductors 47.

According to the aforesaid related rear combination lamp, in the case of attaching the socket 60 to the lamp body 42, the bayonets 65 are aligned to the associated guide grooves 49, respectively, then the socket body 61 is fitted within the socket inlet 45 and then inserted in the direction shown by the arrow B. However, in this case, there is a case that the socket body is further pushed in after the contacts 67*a* have been brought into contact with the conductors 47.

When the socket body is pushed in excessively in this manner, the contacts 67*a* are crushed to raise an excessive deformation and so the elasticity of the contacts is degraded. As a result, there arises a problem that the contacts 67*a* are subjected to the plastic deformation and so the contacting state between the contacts and the conductors 47 becomes failure.

SUMMARY OF THE INVENTION

Accordingly, the invention has been made in view of the aforesaid problem of the related art, and an object of the invention is to provide a rear combination lamp which prevents the excessive deformation of contacts at the time of attaching a lamp socket to a lamp body thereby to surely prevent the contact failure between conductors and the contacts.

In order to achieve the above object, according to the present invention, there is provided a lamp device comprising:

- a socket body for holding a lamp;
- a socket holder provided with a socket inlet into which the socket body is inserted; and
- a stop rib formed on the socket holder in the vicinity of the socket inlet so as to restrict an insertion amount of the socket body.

Preferably, the socket body is provided with a terminal contact, and the socket holder is provided with a conductor which is to be electrically connected with the terminal contact when the socket body is inserted into the socket inlet. Here, the stop rib restricts a further insertion of the socket body when the terminal contact is brought into contact with the conductor.

Preferably, the socket holder is provided with a first face on which the stop rib and the conductor are provided, and the socket body is provided with a second face opposing to the first face, on which the terminal is provided. Here, a top face of the stop rib is brought into contact with the second face when the terminal contact is brought into contact with the conductor.

Preferably, bayonets are provided on an outer periphery of the socket body, and the socket inlet is formed with guide grooves for respectively receiving the associated bayonets. A plurality of stop ribs are provided in the vicinity of the respective guide grooves.

Preferably, one of inner side faces of the respective guide grooves includes a tapered face.

According to the above structure, at the time of attaching the socket body to the socket holder, the bayonets formed at the socket body are aligned in correspondence with the guide grooves, respectively, and then the socket body is inserted into the socket inlet. As a result, the terminal contact provided at the second face of the socket body is brought into contact with the conductor on the first face of the lamp body, and the second face of the socket body abuts against the stop ribs, whereby the socket body is prevented from being further inserted into the socket inlet. Namely, the contact can be prevented from being applied with an excessive force.

Therefore, since the plastic deformation of the contact is prevented and the elastic function thereof is not degraded, the failure of the lighting operation of the lamp due to the contact failure between the contact and the conductor can be surely prevented.

DETAILED DESCRIPTION OF THE PREFERRED EMBODIMENTS

Figure 1:
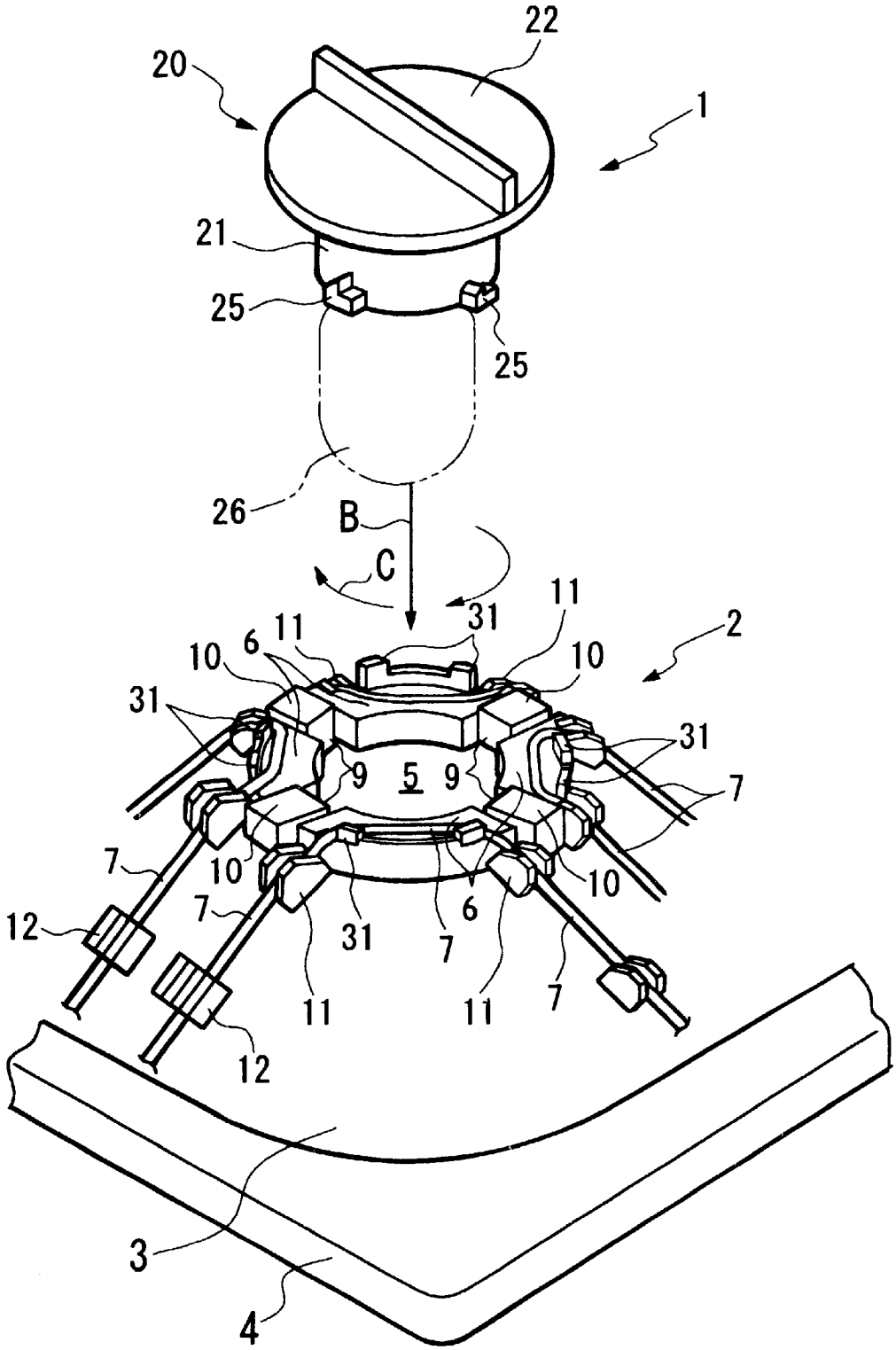
FIG. 1 is an exploded perspective view showing a rear combination lamp according to a first embodiment of the invention.
Figure 3:
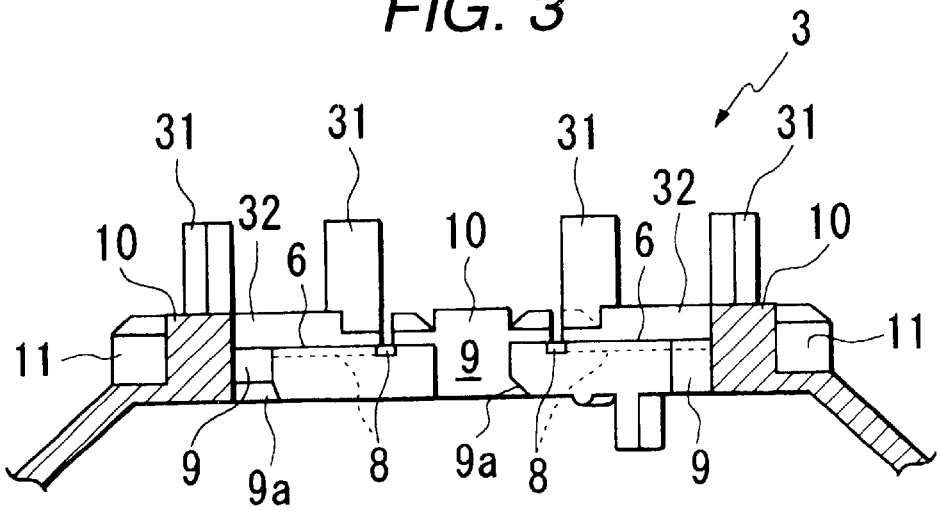
FIG. 3 is a sectional view taken along a line I—I in FIG. 2.
Figure 4:
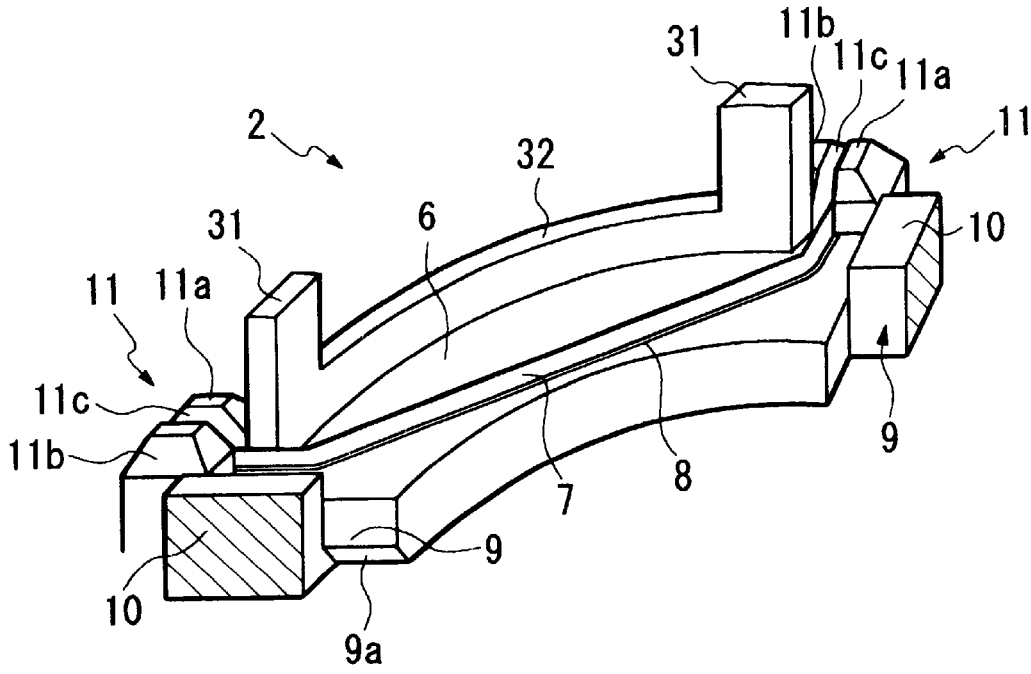
FIG. 4 is a partially enlarged perspective view showing the configuration of a socket inlet and a wiring portion in FIG. 1.
Figure 5:
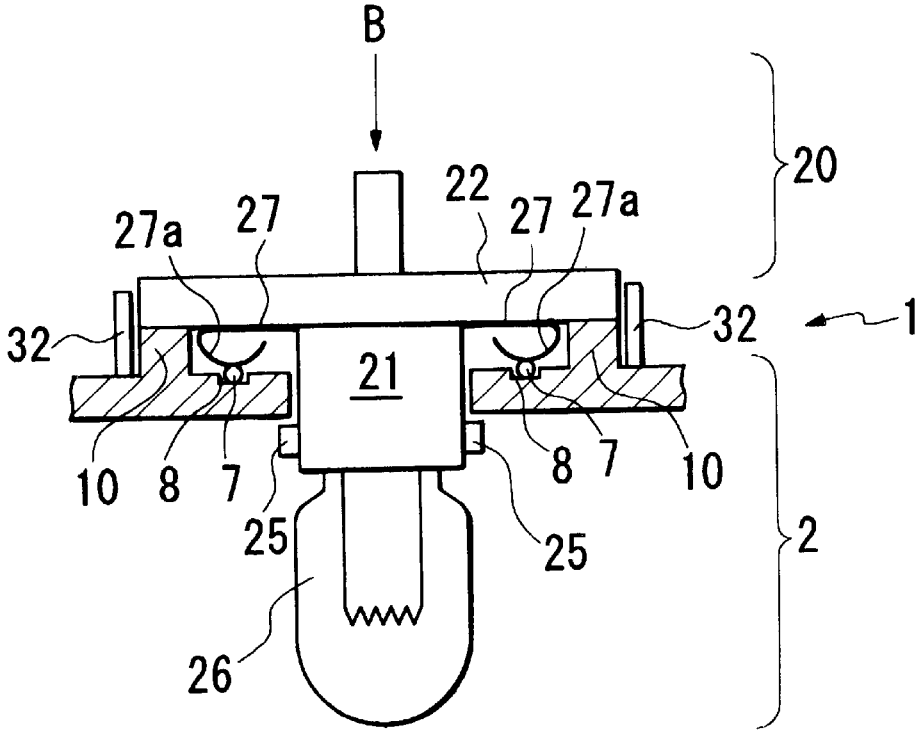
FIG. 5 is a sectional view showing the attachment state between a socket and a lamp body in FIG. 1.

A rear combination lamp according to a first embodiment of the invention will be explained in detail based on FIGS. 1 to 5. FIG. 1 is an exploded perspective view showing the rear combination lamp according to the embodiment of the invention, FIG. 2 is a plan view showing the configuration of a lamp body in FIG. 1, FIG. 3 is a section view along a line III—III in FIG. 2, FIG. 4 is an enlarged perspective view showing the configuration of a socket inlet in FIG. 1 and FIG. 5 is a sectional view showing the attachment state of a lamp socket to the socket inlet.

As shown in FIG. 1, the rear combination lamp 1 according to the embodiment is formed by a lamp body 2 and a socket 20. The rear combination lamp is arranged in a manner that, when the socket 20 is attached to the lamp body 2, a lamp 26 attached to the socket 20 can be coupled to conductors 7. The lamp body 2 is configured by a socket holder 3 formed in a hollow and almost frustum shape and a lens portion 4 formed integrally at the bottom face of the socket holder 3.

Figure 2:
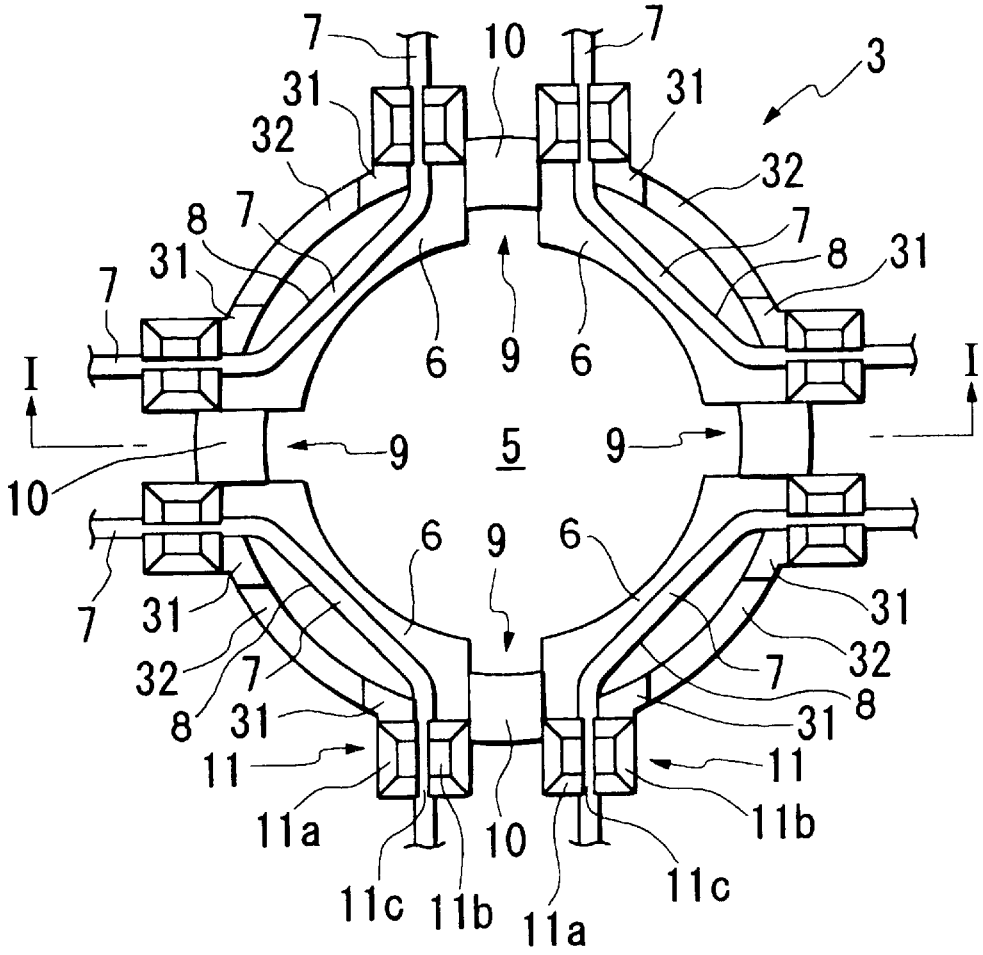
FIG. 2 is a plan view showing the configuration of a socket holder in FIG. 1.

As shown in FIGS. 1 and 2, the conductors 7 are wired in a state that welding ribs 11 and press-fitting ribs 12 for surely winding the conductors 7 are formed on the socket holder 3. Each of the welding ribs 11 is configured in a manner that the conductor 7 is inserted in a slit 11*c* formed between side wall portions 11*a* and 11*b* and thereafter the side wall portions 11*a* and 11*b* are fused thereby to weld the conductor 7.

The press-fitting ribs 12 are formed integrally with the lamp body 2 at the positions for wiring the conductors 7. Each of the press-fitting ribs is arranged in a manner that the conductor 7 is inserted with pressure into a slit formed between a pair of wall portions thereof disposed in an opposite manner thereby to fix the conductor thereto. The lower portion of a socket inlet 5 is formed in a hollow shape and provided at a not-shown inner wall thereof with a reflection mirror for suppressing the loss of light of the lamp within the lamp body 2.

An annular wiring portion 6 is formed around the socket inlet 5 at the peripheral wall on the upper face of the socket holder 3. The conductors 7 are wired on the upper face of the wiring portion 6. The wiring portion 6 is provided at the peripheral portion of the socket inlet 5 with guide grooves 9 for guiding the socket 20 at the time of fitting it with the lamp body. As shown in FIGS. 3 and 4, a tapered face 9*a* is formed on one of side faces at the lower end of each of the guide grooves 9.

Incidentally, the diameter of the socket holder 5 and the number of the guide grooves 9 etc. are not limited to predetermined values and changed in accordance with the standard of the socket 20 attached to the socket inlet 5.

Further, as shown in FIGS. 2 to 4, the wiring portion 6 is provided at the outer peripheral portion thereof with four rectify ribs 31 serving as bending fulcrums when wiring the conductors 7 and four reinforcement ribs 32, each of which are formed in four division manner. Wiring grooves 8 are formed on the wiring portion 6 so that the conductors 7 are fitted into the wiring grooves in a half-buried manner.

The rear combination lamp 1 according to the embodiment is provided with stop ribs 10 each having a flat upper face and a pedestal shape at the outer side of each of the guide grooves 9. Each of the stop ribs 10 serves to restrict the insertion amount of the socket 20 and stably rotate the socket 20 when attaching the socket 20 to the lamp body 2. The function of the stop ribs will be explained in detail later.

Then, the wiring operation of the conductors 7 to the socket holder 3 in the rear combination lamp 1 thus configured will be explained.

As shown in FIG. 2, the four guide grooves 9 are formed with an interval of 90 degrees. The conductors 7 are wired in a half-buried manner within the wiring grooves 8 which are formed so as to avoid the guide grooves 9. Then, the both end portions of each of the conductors 7 are bent by the end portions of the associated rectify ribs 31 serving as the fulcrums, then inserted into the slits 11*c* of the associated welding ribs 11 and sandwiched by the associated press-fitting ribs 12, respectively. Thereafter, the welding ribs 11 are partially fused by being subjected to the heating process etc. thereby to weld the conductors 7.

That is, when wiring the conductors 7 on the entirety of the lamp body 2, the conductors 7 are bent by the associated rectify ribs 31 serving as the fulcrums and inserted into the slits 11*c* of the associated welding ribs 11 and inserted within the slits of the associated press-fitting ribs 12 with pressure, respectively. In this stage, the conductors 7 are fitted within the wiring grooves 8 and placed in a semi-fixed state. Then, the welding ribs 11 are partially fused thereby to weld the conductors 7. Since the press-fitting ribs 12 are configured so that the conductors 7 are inserted therein with pressure, the conductors scarcely move out of the press-fitting ribs. Thus, the conductors 7 are wired at the predetermined positions without being loosen due to the functions of the combination of the press-fitting ribs and the welding ribs 11.

The socket 20 is formed by a socket body 21 and a flange 22 of a circular plate shape. Each of the terminals 27 includes a contact 27*a* at the one end thereof (see FIG. 5). The terminals are inserted in a fitting manner into the socket body 21 in a manner that the contacts protrude on the face of the flange 22 (lower side in FIG. 1) from the side face of the socket body 21.

The socket body 21 is provided on the side wall face thereof with bayonets 25 for positioning and engaging which are fitted into the guide grooves 9 when attaching the socket 20 to the socket inlet 5. The four bayonets 25 are provided in correspondence with the number and the positions of the guide grooves 9. The bayonets 25 are formed with the same configuration in this embodiment.

The operation for attaching the socket 20 to the lamp body 2 will be explained.

As shown in FIG. 1, the socket body 21 is inserted into the socket inlet 5 toward the direction shown by an arrow B in the figure. When the socket body 21 is inserted within the socket inlet, the bayonets 25 fit with the associated guide grooves 9, respectively, and so the socket body 21 is fitted into the socket inlet 5.

Thus, as shown in FIGS. 4 and 5, after the contacts 27*a* are brought into contact with the conductors 7, when the socket body is rotated in the direction shown by an arrow C, that is, toward the tapered face 9*a* side formed at the lower end of the guide groove 9, the bayonets 25 move to the lower side of the wiring portion 6, whereby the socket 20 is stopped by the socket holder 3. In this manner, the socket is attached to the lamp body.

In this embodiment, the stop ribs 10 of a pedestal shape are provided at the outer sides of the respective guide grooves 9. Thus, at the time of attaching the socket 20 to the lamp body 2, when the socket body 21 is intended to be inserted within the socket inlet 5 to a more degree than required, the lower end of the flange 22 abuts against the upper face of the stop ribs 10 as shown in FIG. 5, whereby the socket body is prevented from being further pushed in the direction shown by the arrow B.

That is, as shown in FIG. 5, since the height of the stop ribs 10 is set in a manner that, after the contacts 27*a* are brought into contact with the conductors 7 with pressure, the lower end of the flange 22 abuts against the upper face of the stop ribs 10, so that an excessive pressing force is not applied to the contacts 27*a*. Accordingly, the plastic deformation of the contacts 27*a* is prevented and the elastic function thereof is prevented from being degraded, whereby the contacts 27*a* can be continuously made in contact with the conductors 7 stably and so the conductive failure etc. between the contacts 27*a* and the conductors 7 can be surely prevented.

In this manner, since the one side face of each of the guide grooves 9 is formed as the tapered face 9*a*, when the socket 20 is rotated in the direction shown by the arrow C after inserting the socket body 21 into the socket inlet 5, the bayonets 25 smoothly move to the lower side of the wiring portion 6. Then, in accordance with the rotation of the socket 20, the contacts 27*a* slide while being made in contact with the conductors 7 and further the flange stably slid on the stop ribs while the lower end face of the flange 22 is made in face-contact with the flat upper face of the stop ribs 10.

Accordingly, when attaching the socket 20 to the lamp body 2, the insertion amount of the socket 20 is restricted and further the socket 20 can be rotated stably. Thus, the electrical coupling operation of the lamp 26 attached to the socket body 21 can be performed surely by such a simple operation that the socket 20 is inserted into the socket inlet 5 and then rotated.

Figure 6:
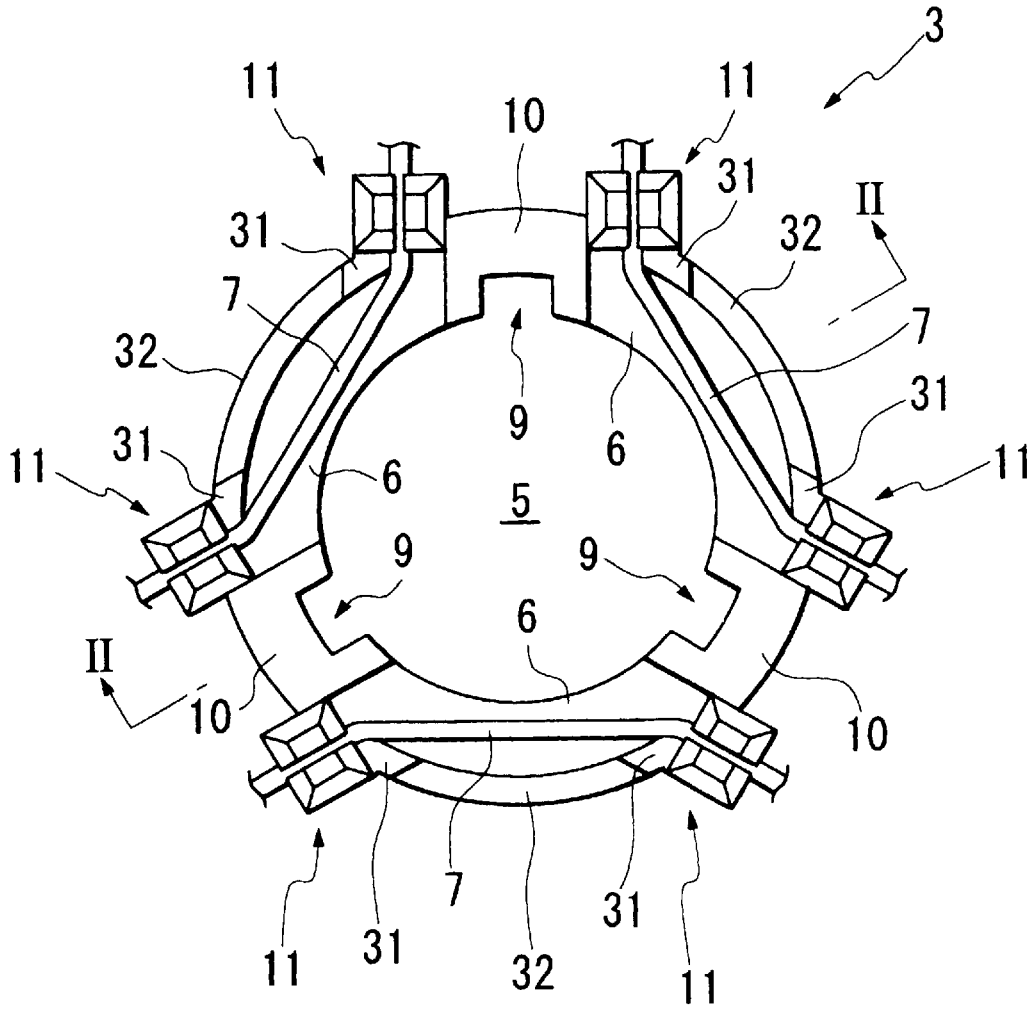
FIG. 6 is a plan view showing a socket holder of a rear combination lamp according to a second embodiment of the invention.
Figure 7:
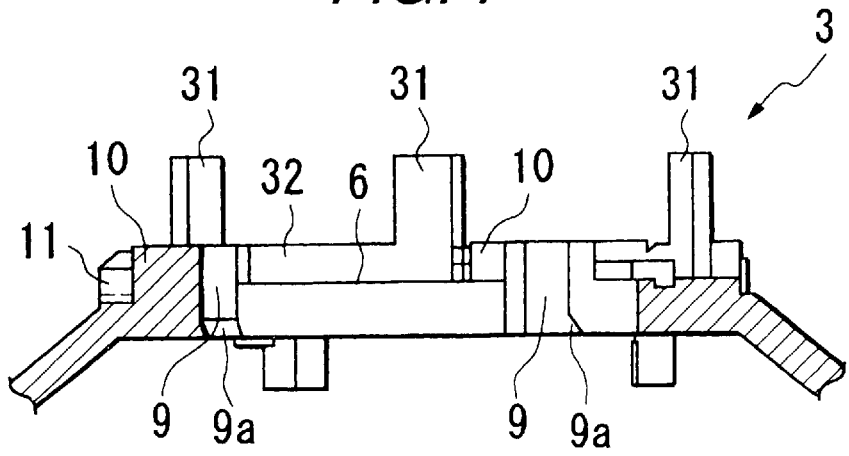
FIG. 7 is a sectional view taken along a line II—II in FIG. 6.

The rear combination lamp according to a second embodiment of the invention will be explained in detail based on FIGS. 6 and 7. FIG. 6 is a plan view showing the configuration of a socket holder provided at a lamp body and FIG. 7 is a sectional view along a line II—II in FIG. 6. This embodiment mainly differs from the first embodiment in the number of guide grooves and the number of wiring portions. In this embodiment, portions identical to those of the first embodiment are referred to by the common symbols, with detailed explanation thereof being omitted.

In this embodiment, as shown in FIG. 6, three guide grooves 9 are formed with an interval of 120 degrees and three stop ribs 10 are formed in a manner that each of the stop ribs surrounds three sides of the associated guide groove. Thus, a wiring portion 6 is also divided into three pieces and conductors 7 are wired at the respective pieces of the wiring portion 6. Bayonets formed at a socket is configured in a manner that the numbers and the positions of the bayonets correspond to the guide grooves 9.

In this embodiment, when attaching the socket to the lamp body, the not-shown bayonets are aligned to the associated guide grooves 9, respectively, and a socket body is inserted into a socket inlet 5. In this case, the conductors 7 and not-shown contacts contact to each other like the aforesaid embodiment, and then the flange of the socket abuts against the upper face of the stop ribs 10, whereby the socket is restricted from being further inserted.

Accordingly, also in this embodiment, like the first embodiment, the excessive deformation of the contacts can be prevented and the failure of the lighting operation of the lamp due to the contact failure with the conductors can be surely prevented.

Figure 8:
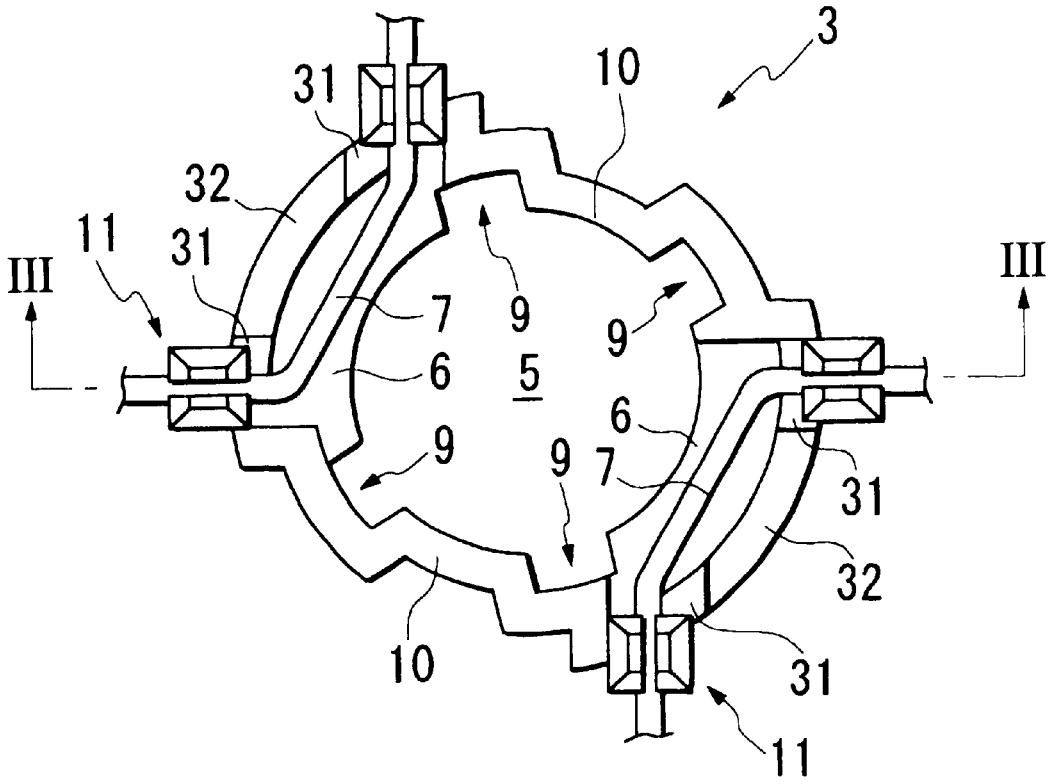
FIG. 8 is a plan view showing a socket holder of a rear combination lamp according to a third embodiment of the invention.
Figure 9:
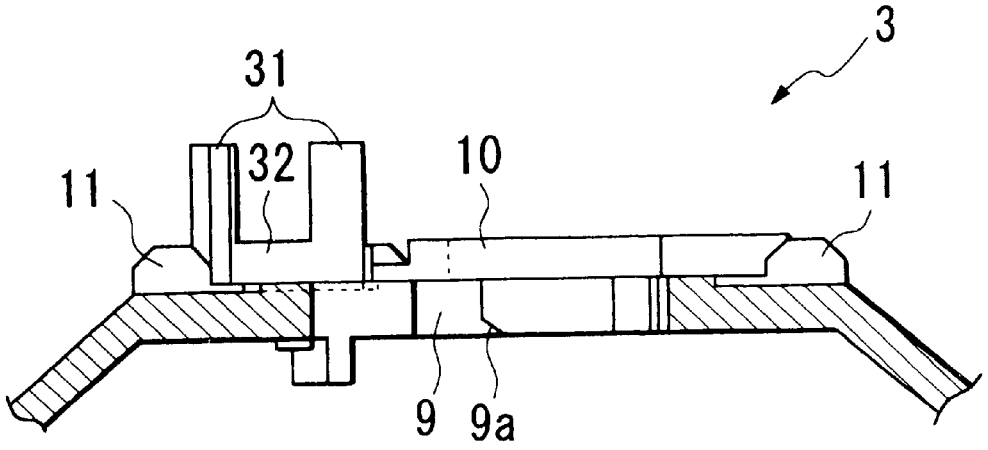
FIG. 9 is a sectional view taken along a line III—III in FIG. 8.
Figure 10:
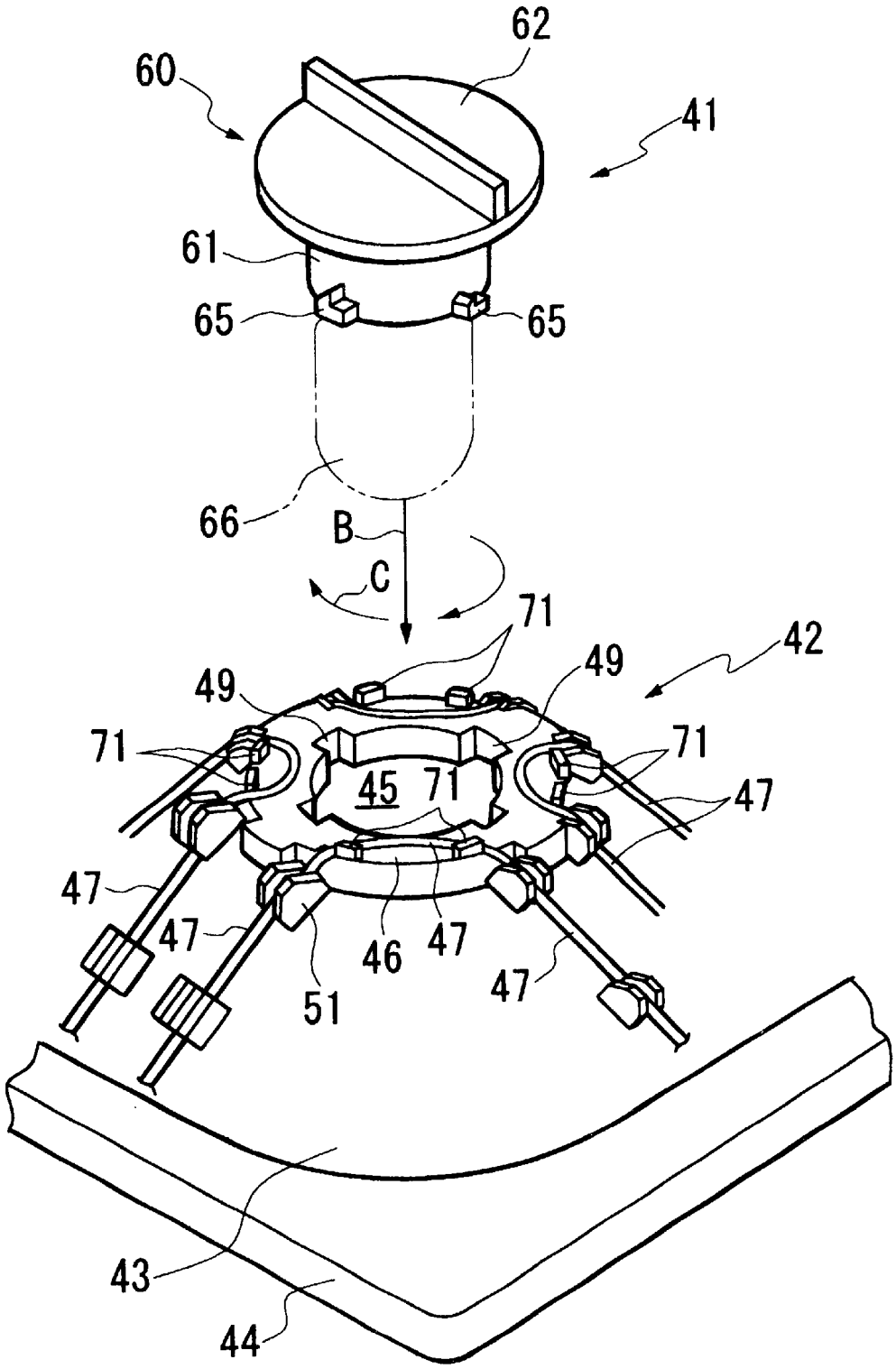
FIG. 10 is an exploded perspective view showing a related rear combination lamp.
Figure 11:
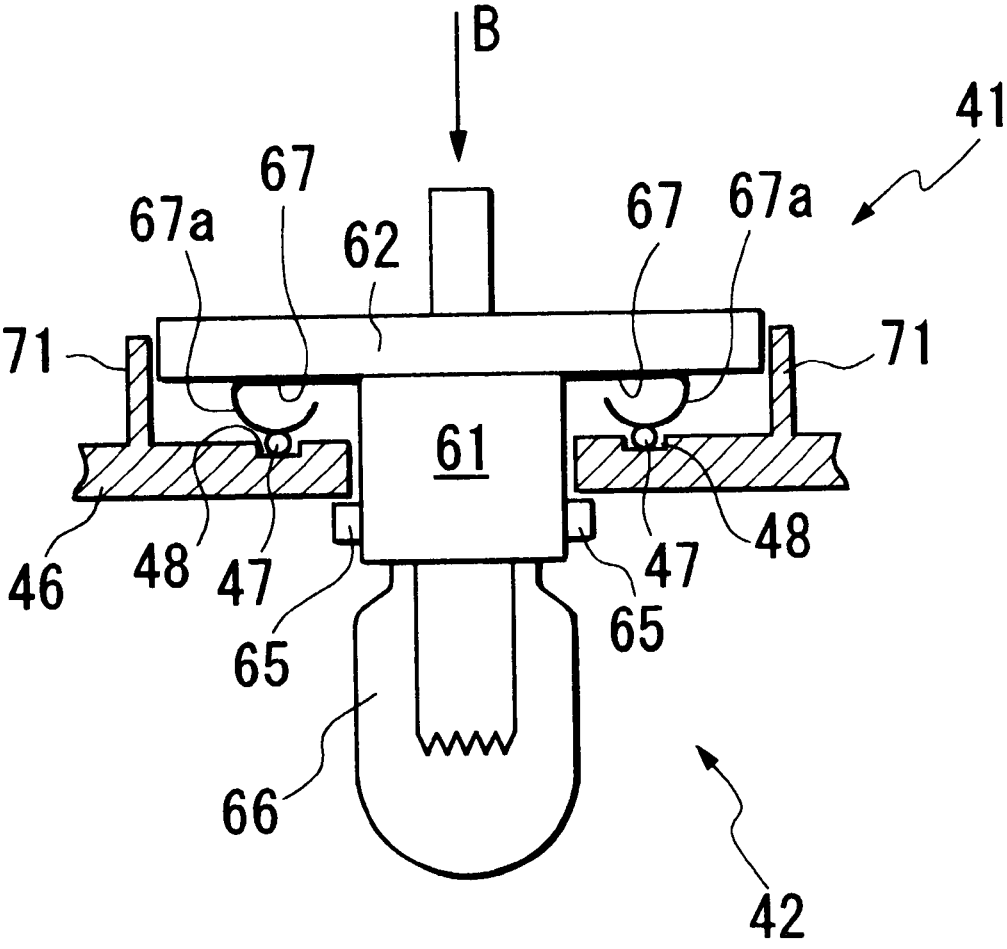
FIG. 11 is a sectional view showing the attachment state between a socket and a lamp body in FIG. 10.

The rear combination lamp according to a third embodiment of the invention will be explained in detail based on FIGS. 8 and 9. FIG. 8 is a plan view showing the configuration of a socket holder provided at the lamp body and FIG. 9 is a sectional view along a line III—III in FIG. 9. This embodiment mainly differs from the first embodiment in the number of guide grooves and the number of wiring portions and in the shape of strip ribs. In this embodiment, portions identical to those of the first embodiment are referred to by the common symbols, with detailed explanation thereof being omitted.

In this embodiment, guide grooves 9 are not formed with a constant interval. That is, two of the four guide grooves 9 are disposed closely. Two stop ribs 10 are provided. In this embodiment, each of the stop ribs 10 is formed so as to bridge the adjacent guide grooves 9 by the arc shaped portion thereof.

A wiring portion 6 is divided into two pieces and conductors 7 are wired at the respective pieces of the wiring portion 6 like the aforesaid embodiments. The function of the rectify ribs etc. at the time of wiring the conductors 7 is same as the aforesaid embodiments. The numbers and positions of the bayonets of a not-shown socket are arranged so as to correspond to the guide grooves 9.

In this embodiment, when attaching the socket to the lamp body, the not-shown bayonets are aligned to the associated guide grooves 9, respectively, and a socket body is inserted into a socket inlet 5. In this case, the conductors 7 and not-shown contacts are brought into contact with each other like the aforesaid embodiments, and then the one end of the flange of the socket abuts against the flat upper face of the stop ribs 10, whereby the socket is restricted from being further inserted.

Accordingly, like the first embodiment, the plastic deformation of the contacts due to the excessive deformation thereof can be prevented and so the failure of the lighting operation of the lamp due to the contact failure between the contacts and the conductors can be surely prevented.

As described above, the stop ribs according to the invention can be formed at the wiring portion regardless of the number of the guide grooves and the shape of the wiring portion etc. and also can surely restrict the insertion amount of the socket. Thus, the excessive deformation of the contacts caused by the insertion of the socket can be prevented and so the failure of the lighting operation of the lamp due to the contact failure between the contacts and the conductors can be surely prevented.

What is claimed is:

1. A lamp device comprising:

a socket body for holding a lamp;

a socket holder provided with a socket inlet into which the socket body is inserted; and a stop rib formed on the socket holder in the vicinity of the socket inlet so as to restrict an insertion amount of the socket body.

2. The lamp device as set forth in claim 1, wherein bayonets are provided on an outer periphery of the socket body, and the socket inlet is formed with guide grooves for respectively receiving the associated bayonets; and wherein a plurality of stop ribs are provided in the vicinity of the respective guide grooves.

3. The lamp device as set forth in claim 2, wherein one of inner side faces of the respective guide grooves includes a tapered face.

4. The lamp device as set forth in claim 1, wherein the socket body is detachably inserted into the socket inlet.

* * * * *